US005862829A

United States Patent [19]

Sand

[11] Patent Number: 5,862,829

[45] **Date of Patent: *Jan. 26, 1999**

[54] AIR GAP EDUCTOR

[75] Inventor: William F. Sand, Cincinnati, Ohio

[73] Assignee: Hydor Systems Company

[ * ] Notice: The term of this patent shall not extend beyond the expiration date of Pat. No. 5,522,419.

[21] Appl. No.: 802,729

[22] Filed: Feb. 20, 1997

[51] Int. Cl.[6] ..... E03C 1/10

[52] U.S. Cl. ..... 137/216; 137/888

[58] Field of Search ..... 137/216, 888

[56] References Cited

U.S. PATENT DOCUMENTS

| | | |
|---|---|---|
| 141,361 | 7/1873 | Korting . |
| 316,804 | 4/1885 | Messinger . |
| 333,086 | 12/1885 | Strickland . |
| 412,032 | 10/1889 | Mack . |
| 536,415 | 3/1895 | Bogert . |
| 689,891 | 12/1901 | Labadie . |
| 1,016,772 | 2/1912 | Pottel . |
| 1,102,505 | 7/1914 | Henderson . |
| 1,195,915 | 8/1916 | Damrow . |
| 1,484,345 | 2/1924 | Stoelting . |
| 1,687,386 | 10/1928 | Reeve . |
| 1,784,222 | 12/1930 | Crickmer . |
| 1,803,628 | 5/1931 | Lathrop . |
| 2,250,291 | 7/1941 | Boosey . |
| 2,288,247 | 6/1942 | Kunstorff . |
| 2,631,448 | 3/1953 | Garman . |
| 3,072,137 | 1/1963 | McDougall . |
| 3,166,086 | 1/1965 | Holmes . |
| 3,273,866 | 9/1966 | Lancy . |
| 3,411,524 | 11/1968 | Raine et al. . |
| 3,643,692 | 2/1972 | Traylor . |
| 4,221,406 | 9/1980 | Traylor . |
| 4,250,920 | 2/1981 | Traylor . |
| 4,469,131 | 9/1984 | Traylor . |
| 4,553,587 | 11/1985 | Traylor . |
| 4,623,123 | 11/1986 | Traylor . |
| 4,697,610 | 10/1987 | Bricker et al. . |
| 4,721,126 | 1/1988 | Horii . |
| 4,771,485 | 9/1988 | Traylor . |
| 4,856,121 | 8/1989 | Traylor . |
| 4,892,463 | 1/1990 | Meyer et al. . |
| 5,159,958 | 11/1992 | Sand . |
| 5,176,165 | 1/1993 | Traylor . |
| 5,253,677 | 10/1993 | Sand . |
| 5,305,778 | 4/1994 | Traylor . |
| 5,518,020 | 5/1996 | Nowicki et al. . |
| 5,522,419 | 6/1996 | Sand . |
| 5,673,725 | 10/1997 | Russell et al. ..... 137/888 |

FOREIGN PATENT DOCUMENTS

| | | |
|---|---|---|
| 1428452 | 1/1969 | Germany . |

*Primary Examiner*—Gerald A. Michalsky
*Attorney, Agent, or Firm*—Wood, Herron & Evans LLP

[57] ABSTRACT

A three-piece air gap eductor includes a molded body having air gap, discharge and venturi sections, a nozzle and a spray shield extending about the venturi section entry to constrain turbulence and reduce backsplash and spray exiting the air gap chamber. A water stream engaging the outer-driven venturi is smoothly divided into respective venturi and bypass streams, with the frustoconical shield capturing turbulent water outside the venturi in a water sheet moving toward a discharge. An improved shield is frustoconically shaped, has an internal reflection shoulder and external moister collecting bars to enhance mist and spray reduction in the air gap section. A V-shaped recess in the shield facilitates its emplacement about the venturi section. The molded body is stiffened to avoid functional misalignment of the water stream between the nozzle and the venturi.

24 Claims, 7 Drawing Sheets

AIR GAP EDUCTOR

BACKGROUND OF THE INVENTION

This invention relates to fluid handling and more particularly to dispensing or proportioning apparatus, namely anti-backflow proportioners known as air gap eductors.

In the past, it has been common to dispense concentrated chemical fluids by sucking them up through a venturi into a water stream and dispensing a flow of mixed water and chemicals. Mixers known as eductors accomplish this task by providing a water flow through a venturi section and sucking chemicals into the flow through a low pressure orifice in the venturi section. Such eductors are useful in a number of applications, such as in dispensing diluted cleaning agents for cleaning procedures.

In these systems, it is important to maintain the water source free of contamination so that chemicals are not drawn back into the water source. This has been accomplished through the use of backflow preventors such as air gap eductors. In essence, such air gap eductors include a nozzle upstream of the venturi section for defining a stream of water flowing across an unobstructed gap in the eductor body prior to entering the venturi section. Upon any water shut down or pressure reversal in the water system, the water stream terminates, leaving a gap in the eductor between the nozzle and the venturi section where the chemical is otherwise first introduced. There is thus no mechanism capable of transmitting chemical back to the nozzle or upstream in the water supply. Typically, the eductor body is provided with open (or baffled) windows in the gap area to accommodate and pass any water overspray during operation.

Forms of air gap eductors are disclosed, for example, in U.S. Pat. Nos. 5,519,958; 5,522,419 and 5,253,677 specifically and expressly incorporated herein by reference.

While certain of the former air gap eductors have proven very useful, such eductors still have room for improvement. For example, it is desirable to minimize and eliminate overspray and misting in the air gap section to obtain a drier, less messy operating environment.

Many factors may contribute to such overspray. One factor is the dynamic of the water stream as it enters the venturi section. Since it is generally considered desirable to overdrive the venturi, that is to direct more water into the venturi than can flow therethrough, some portion of the water stream never flows into and through the venturi, but rather flows around its outside structure as overflow, back splash, droplets, spray, mist or the like. It is desirable to control this overflow and to minimize or reduce its flow back into the air gap area or chamber.

Also, it is important to maintain alignment of the water stream from the nozzle into the venturi opening. If the stream is misaligned, overspray greatly increases, causing too much splashing, back spatter and misting. Such misalignment may be caused, for example, by any undesirable flexation of the eductor body structure between the nozzle and the venturi section. Such flexation may be caused, for example, by manipulation of the discharge hose extending from the eductor. Accordingly, it is desirable to provide an eductor body sufficiently rigid to prevent water stream misalignment.

Also, it is noted that the overspray discharge of certain eductors generally surrounds the primary mix discharge and includes air. When discharged into the same receptacle, such as a bucket, for example, this aerated overspray discharge causes undesirable foaming. It is thus desirable to reduce or eliminate foaming due to turbulent overspray discharge.

In another aspect of air gap eductors, various governmental authorities or certifying agencies have developed codes or standards for air gap eductors. A typical standard is the rquirement that the air gap between the upstream nozzle and the venturi be at least one inch (i.e. 2.54 centimeters) in length, and that the distance from the nozzle orifice to the interior surface of the eductor body be at least four times the diameter of the nozzle orifice.

In yet another aspect of the invention, it is noted many prior eductors require numerous parts, raising their costs and their assembly expense. It is desirable to provide an air gap eductor meeting significant code limitations, reducing or eliminating overspray, backsplash and foaming, and at the same time of few parts.

It is thus one objective of the invention to provide an improved air gap eductor which minimizes or eliminates misting, overspray, backsplashing and the like into the air gap chamber.

Another objective of the invention has been to provide an improved air gap eductor with reduced foaming discharge.

Another objective of the invention is to provide an improved air gap eductor with reduced overspray and reduced foaming discharge while retaining an air gap over one inch between water nozzle and venturi entry and a distance of four times the nozzle orifice diameter between the nozzle orifice and internal surfaces of the eductor body.

Another objective of the invention is to provide an improved air gap eductor of molded configuration of only three separate body parts.

A further objective of the invention has been to provide an improved overspray and misting shield for an air gap eductor.

To these ends, an eductor according to a preferred embodiment of the invention includes an integrally molded eductor body, a nozzle fitting in the body and an overspray shield fitting over an integrally molded venturi section in the body. The nozzle fits within the body at a water inlet end to define a water stream. The shield fits into the body at the downstream end of an air gap chamber defined by the body and is of a construction to cooperate with the venturi section to control overspray and backsplash. In particular, the shield is of frustoconical configuration fitting over a tapered inlet end of the venturi section. The shield has a plurality of parallel spray deflecting rods extending outwardly toward interior eductor wall surfaces and is positioned by four spider-like arms within the body. A conical skirt of the shield extends around the venturi inlet and has a V-shaped cut to accommodate the integral portion of the venturi's attachment or projection from the eductor body. The upstream interior surface of the conical skirt just at the venturi inlet terminates at a shoulder useful for preventing backsplash.

The venturi inlet is formed in a venturi section projection from the eductor body and is defined in part by two diverging walls and a conical surface therebetween, with the skirt of the shield overlying these surfaces. The venturi inlet is an open bore centered on the knife edge. This edge cleanly cuts the stream of water from the air gap chamber into a main venturi stream and a bypass stream, resulting in a bypass stream of significant velocity and momentum. This improves the flow around the venturi minimizing turbulence and misting or droplets moving upstream. Overflow water or spray not entering the venturi is captured by the shield, tends to form a water sheet thereon and eventually flows downstream capturing ambient mist or droplets. Mist generated by the turbulence of the venturi entry and exiting the shield generally flows downstream. Any mist tending to flow upstream outside the shield collects on the rods and eventually flows downstream into the discharge.

The clearances between the skirt and the venturi section are minimal, as shown in the drawings, to handle overspray while open areas around the outside of the shield and interior of the eductor body provide sufficient venting to allow overspray to flow downstream but without undue foaming in any discharge receptacle.

Such construction permits the efficient use of relatively large venturi passages as compared with past units and the efficient mixing and discharge at high flow rates of 4 to 6 gallons per minute, for example. More chemical flow is thus provided.

Accordingly, the preferred embodiment of the invention reduces or eliminates back splashing and misting, improves the discharge quality and provides an improved air gap eductor of few parts and less expensive integrally molded features.

These and other advantages will be readily apparent from the following detailed description of a preferred embodiiment and from the drawings in which:

DETAILED DESCRIPTION

Figure 1:
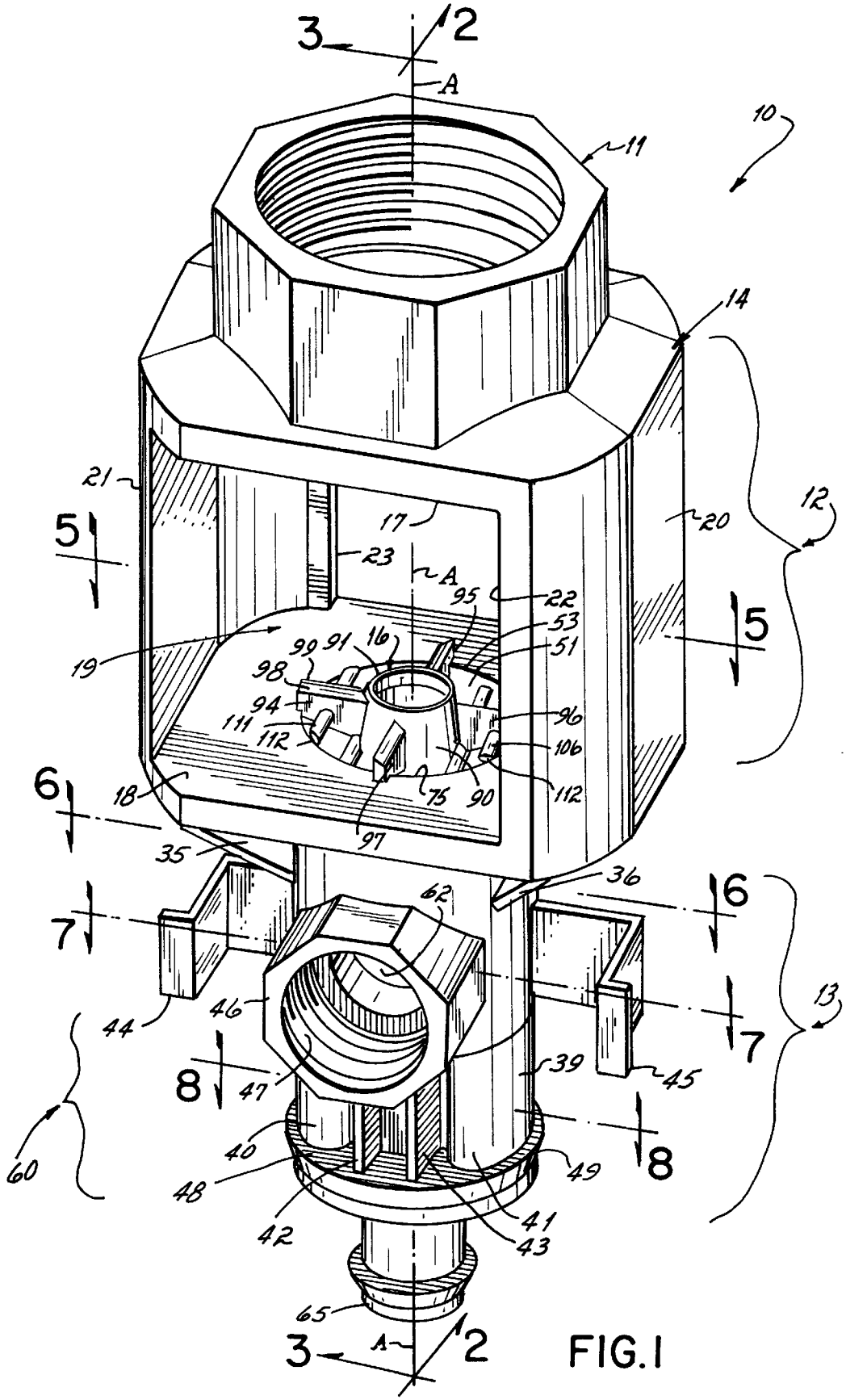
FIG. 1 a perspective view of a preferred embodiment of the invention shown in a typical use orientation.
Figure 1A:
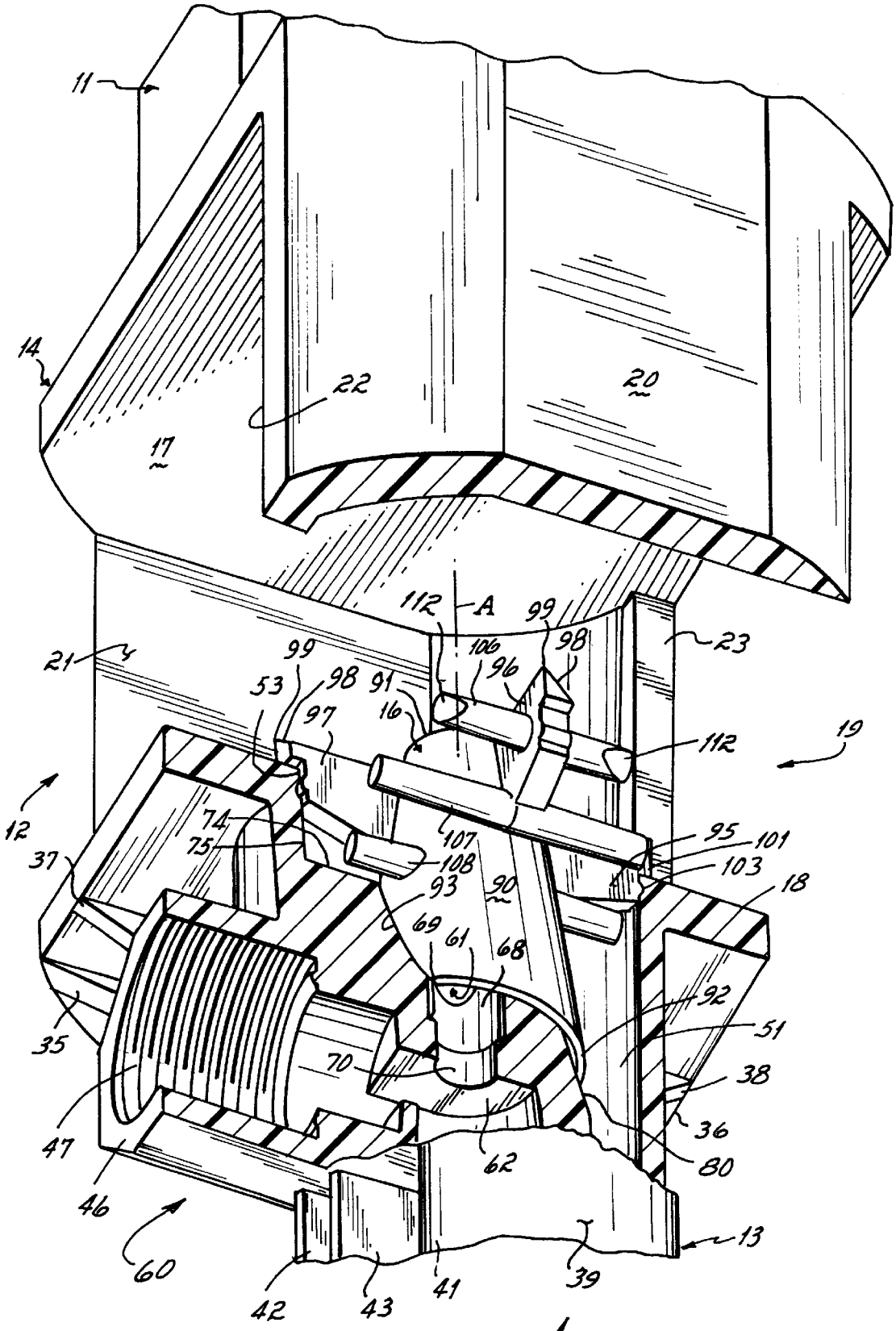
FIG. 1A is a perspective view of the invention of FIG. 1 in partially cut-away form.

Turning now to the drawings, there is shown in the figures an air gap eductor or proportioner 10. The air gap eductor 10 includes an integral entry end 11 comprising preferably a hexagonal boss or female fitting internally threaded, for the receipt of a standard hose or faucet end and through which water is introduced into the system. The eductor 10 further comprises an integral air gap section 12 and an integral discharge section 13. The inlet end 11, air gap section 12 and discharge section 13 are all integrally molded in one piece to form an eductor body 14.

It will be appreciated that while the body 14 can be constructed of any suitable material, it is preferably made of material having a high modulus against flexation. Accordingly, one suitable material which has been utilized is a material comprising a nylon base filled with ceramic and glass. Such material is known as Esbrid and is obtainable from Thermofill, Incorporated of Brighton, Mich. Preferably, the air gap eductor 10 includes three separate components, those being the integral eductor body 14, a nozzle member 15 (FIG. 2, FIG. 3) and a shield 16 (FIGS. 1A, 2, 3 and 4).

An air gap chamber 19 is defined in the body in part by upstream end wall 17 and downstream end wall 18. Moreover, side walls 20 and 21, in air gap section 12, define windows 22, 23 therein, so that the air gap chamber 19 is open through the windows. In this connection, it will be appreciated that the air gap section 12 is of generally rectangular configuration and that the walls 20, 21 are asymmetric, but are similar mirror images of each other, so that one end of each respective wall extends around a respective corner of the rectangular configuration of the air gap section, while the other end of the wall stops short of such corner, as shown in the figures.

With this configuration, together with the relatively thick end walls 17, 18, the air gap section provides a rigid body member which is not yieldable under ordinary forces typically applied in use and ends 17, 18 are relatively fixed and do not shift with respect to each other.

Figure 2:
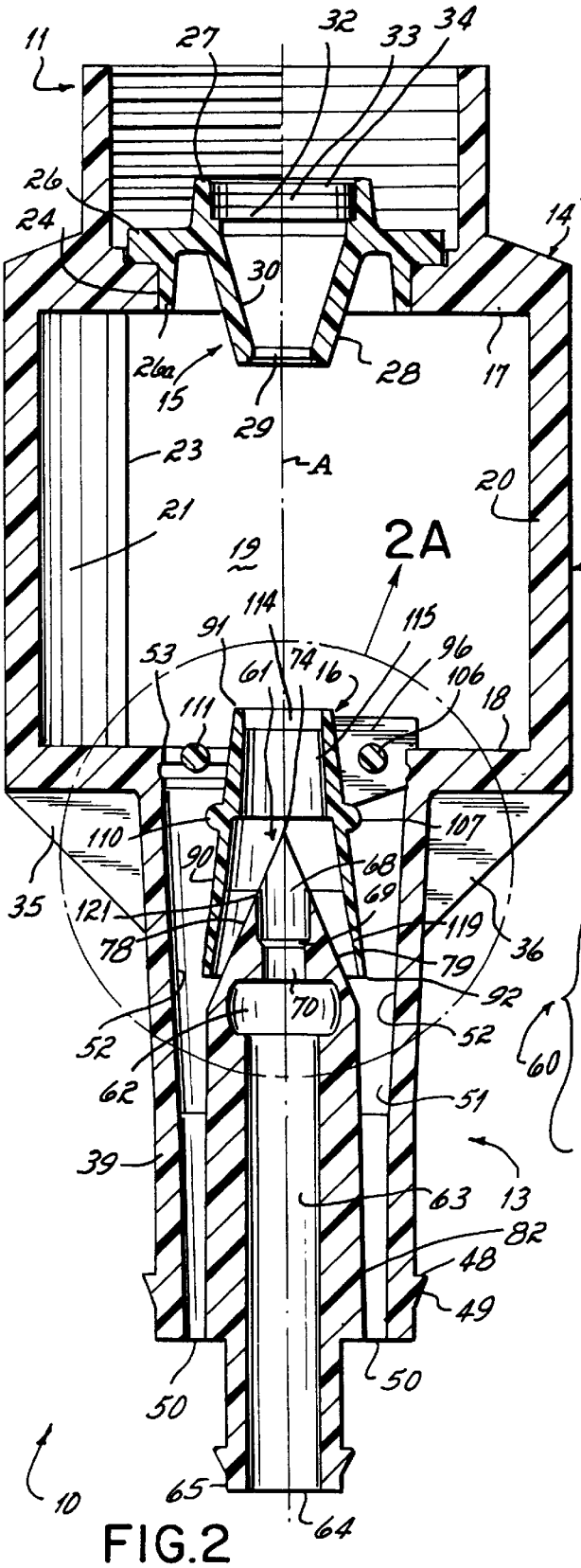
FIG. 2 is a cross-section view taken along lines 2—2 of FIG. 1.
Figure 3:
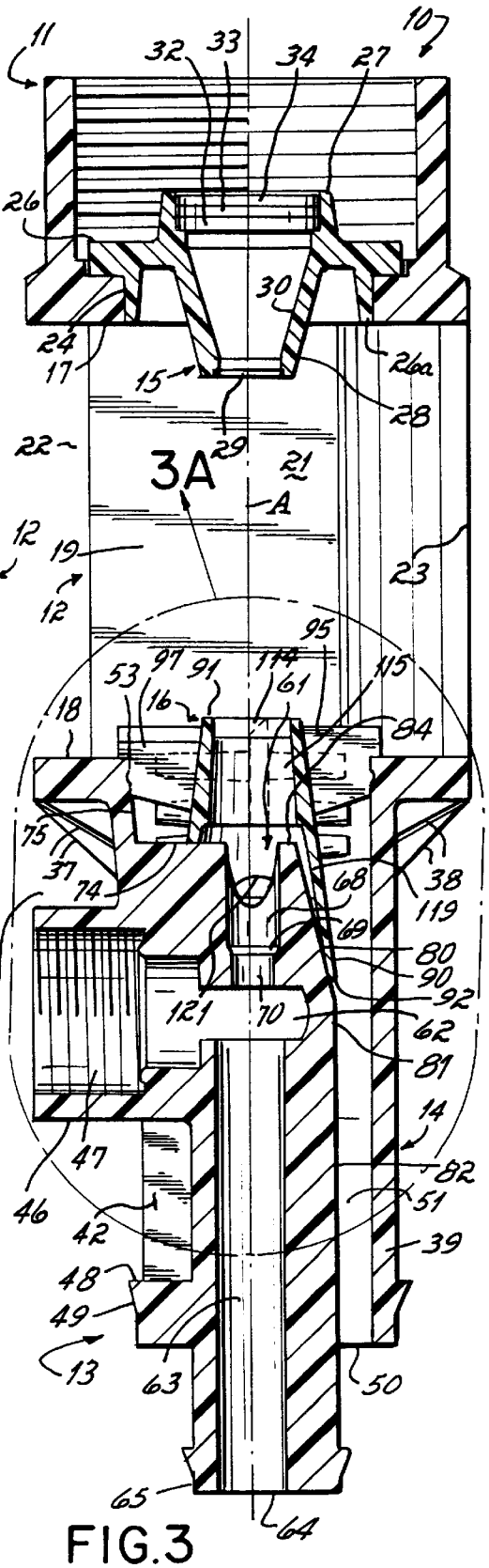
FIG. 3 is a cross-sectional view taken along lines 3—3 of FIG. 1.

Turning now briefly to FIGS. 2 and 3, it will be appreciated that the nozzle member 15 comprises a generally circular-shaped part including a circular flange 26, an upwardly-extending cylindrical boss 27 and a frusto conically shaped tapered having a nozzle opening 29. Nozzle 28 is frustoconically-shaped, having an inwardly tapered sidewall 30 for forming a stream to flow through opening 29 across the chamber 19. The nozzle 15 also includes a depending circular projection 26*a* depending from the flange 26, sized for frictional fit within the aperture 24 in the upstream end wall 17 of the air gap section 12.

Three circular mesh or screen discs 32, 33, 34 are disposed within the cylindrical boss 27. When water is introduced to the inlet end 11 of the air gap eductor 10, the screens 32, 33, 34 serve to smooth out the water flow and provide a laminar, non-turbulent flow into the nozzle 28 to facilitate the columnization of the water stream exiting through the orifice 29.

It will be appreciated that with the diameter of nozzle opening 29 at approximately 0.161 inches, the goal of maintaining a distance from the nozzle opening to the interior walls 20, 21 is easily obtained. It will thus also be appreciated that the distance from one interior wall to the opposite interior wall is equal to or greater than nine times the diameter of the nozzle opening 29, while the space from any part of the edge of the nozzle opening 29 to its most nearly adjacent side wall is equal to or greater than four times the diameter of the nozzle opening 29.

Continuing now with a description of the overall air gap eductor 10, it will be appreciated that the air gap section 12 is larger in cross-sectional area than the discharge section 13 formed integrally therewith. It will be appreciated that a plurality of ribs, such as 35, 36, extend between the downstream end of air gap section 12 to the discharge section 13 in order to stiffen the entire eductor body at this juncture.

While only several ribs 35–38 are shown in FIG. 1, for example, a plurality of ribs are preferably utilized between the downstream end wall 18 of the air gap section 12 and the discharge section 13 for stiffening purposes. Such ribs help also the ensure the rigidity of the body 14, such that any manipulation of the body in normal application will not cause the body to flex, particularly in the area of the air gap chamber.

For example, as will be later described, various discharge hoses are interconnected to the air gap eductor. When these hoses are manipulated into a receptacle like a bucket, for example, they may tend to bend or flex the discharge section 13 with respect to the air gap section 12. Any such bending or flexure could cause a misalignment between the end walls 17, 18 of the air gap chamber 19 and, more particularly, between the alignment of the nozzle 15 with the venturi section later to be described. Such misalignment could cause a malfunction or misalignment of the stream of water across chamber 19 and a resulting reduction in the efficiency of the unit in terms of both eduction and in terms of backsplash and spitting as will be described. Thus sufficient ribbing and stiffeners are utilized to prevent such undesirable flexation within the body.

Figure 8:
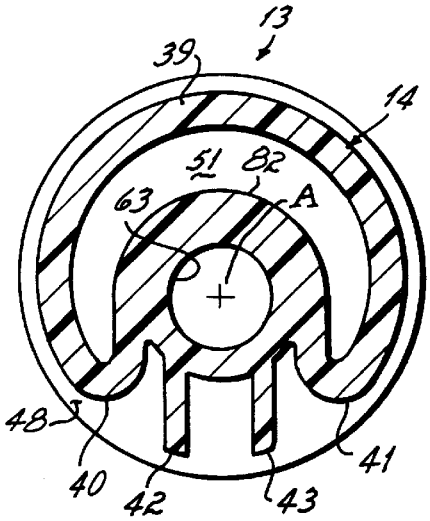
FIG. 8 is a cross-sectional view taken along lines 8—8 of FIG. 1.

The discharge section 13 includes an integral elongated body 39 integrally formed with the body 14 of the air gap eductor 10. As shown perhaps best in FIG. 1 and in FIG. 8, the elongated body 39 is formed in part by elongated convolutions 40, 41, which serve to further aid in the stiffness of the discharge section 13. Elongated integral ribs 42, 43 also extend integrally from the elongated body 39 for stiffening purposes.

An eductor fitting or boss 46 extends transversely outwardly from the elongated body 39 and is provided with internal threading 47 or receiving a connecting plug to facilitate the connection of the eductor to a chemical source or to a chemical source selector valve, such as in the manner shown in U.S. Pat. No. 5,377,718, expressly incorporated herein by reference, or in co-pending U.S. patent application Ser. No. 08/673,332, filed Jun. 28, 1996, now U.S. Pat. No. 5,653,261, also expressly incorporated herein by reference.

To facilitate interconnection to a selector valve, for example, two integral clips 44, 45 extend from each side of the discharge section 13 and elongated body 39. The outwardly turned ends of these clips fit through cooperating slots in a selector valve and hold the eductor 10 thereon. A similar construction and cooperation is shown in patent application Ser. No. 08/673,332 filed Jun. 28, 1996, now U.S. Pat. No. 5,653,261, except that the clips there are on a separate clamp and not integral with the eductor.

Ribs 42 and 43 thus also extend integrally from an inward portion of the fitting 46, as shown in FIG. 1 and in FIG. 3, for example, and terminate integrally in a circular flange 48 having a taper 49 thereon for receiving and holding a discharge hose (not shown). Disc or flange 48 is integral with the body 39 and defines an outlet 50 from the discharge section 13 for passing bypass water which is not directed through the venturi section, to be described.

Thus, the discharge section 13 and the body 39 define, in part, an internal discharge passageway 51, which extends in an upstream direction from the discharge outlet 50 to the opening 53 in the downstream end wall 18 of the air gap chamber 19. Passageway 51 is thus vented through chamber 19 and windows 22, 23. From FIG. 6 it will be appreciated that passageway 51 is tapered inwardly, on each side, in a downstream direction as shown by inwardly inclined passage wall 52.

Turning now momentarily to FIG. 3, it will be appreciated that there is provided in the body 14, and particularly in the discharge section 13, an integral venturi section 60. Venturi section 60 includes a venturi inlet 61, an eductor inlet 62 and a venturi discharge passage 63, terminating at a discharge outlet 64 at an end 65 of the venturi section 60 which is all integrally molded in body 14.

An entire venturi flow-through passageway comprises a first entry bore 68 of a first diameter, an inward taper 69, a second bore 70 of smaller diameter than that of the entry bore 68, the eductor inlet 62 and the venturi discharge passage 63.

It will be appreciated that the eductor inlet 62 communicates with the eductor fitting or boss 46. Accordingly, when fluid is driven through the venturi inlet and through bores 68. 70, past the eductor opening 62 and then into the larger diameter venturi discharge passage 63, an area of low pressure is generated at the eductor inlet 62 and the low pressure generated is sufficient is pull up chemicals to which the eductor fitting 46 is operatively attached or selected. This intermixes chemicals pulled through the eductor opening 62 into the stream flowing through the bores or passages 68, 70 and 63, thereby intermixing the flow with the chemical through the eductor inlet 62 and discharging the resultant mix through the outlet 64.

Turning now to the construction of the venturi section 60, it will be appreciated that the venturi section 60 comprises an integrally molded portion of the body 14 and thus of the body 39. The venturi itself extends thus from a discharge passage sidewall 75 into the discharge passage 51 so that the bores 68, 70 and 63 are coaxial with an axis "A" extending coaxially through the inlet 11, the nozzle 15, the air gap chamber 19 and the discharge section 13.

It will also be appreciated that the bores 68, 70 and 63 are preferably cylindrical in configuration, while the taper 69 is of generally frustoconical shape, tapering inwardly toward axis A from the bore 68 to the smaller diameter bore 70.

The inlet end of the venturi section 60 is formed in part by a knife edge 74 of body material extending, for example, from an interior wall 75 of the discharge passage 51 outwardly and into the passage 51. This edge 74 is perhaps best seen in FIGS. 3, 2A and 6, as well as in FIG. 1A.

The inlet end of the venturi is further defined by two opposed flat surfaces 78, 79 (FIG. 2A and 6) outwardly inclined in a downstream direction, each of which extend outwardly from the interior wall 75 of the discharge passage 51. At the outer side of the venturi inlet from the interior wall 75 in passageway 51, the two flat surfaces 78, 79 are joined together by a rounded conically-shaped surface 80, tapering outwardly in a downstream direction, away from the axis A to the circular junction 81 with the outer generally semi-cylindrical surface 82 of the venturi discharge passage 63.

It will be appreciated that the included angle between the outwardly inclined flat surfaces 78, 79 is preferably in the range of 35 to 55 degrees.

As perhaps best illustrated in FIGS. 2 and 3, it should be appreciated that the nozzle orifice or outlet 29 is of a larger diameter than the first bore 68 of the venturi inlet. While the dimensions of these features may vary, one particular parameter found to be suitable is where the nozzle 29 has a diameter of about 0.161 inches, while the first bore 68 has a diameter of about 0.149 inches and the second venturi bore 70 has a diameter of approximately 0.132 inches. These dimensions have been found suitable in an air gap eductor according to the invention, capable of flow through of four gallons per minute.

Accordingly, it will be appreciated that the stream of water flowing through the nozzle opening 29 is larger than the opening at the venturi inlet defined across the knife edge 74 by the bore 68. The knife edge 74 thus cleanly cuts the water stream dividing it into a main stream flowing into the interior bore 68 and a bypass water stream, which flows outside the venturi section 60 but within the discharge passageway 51.

Figure 6:
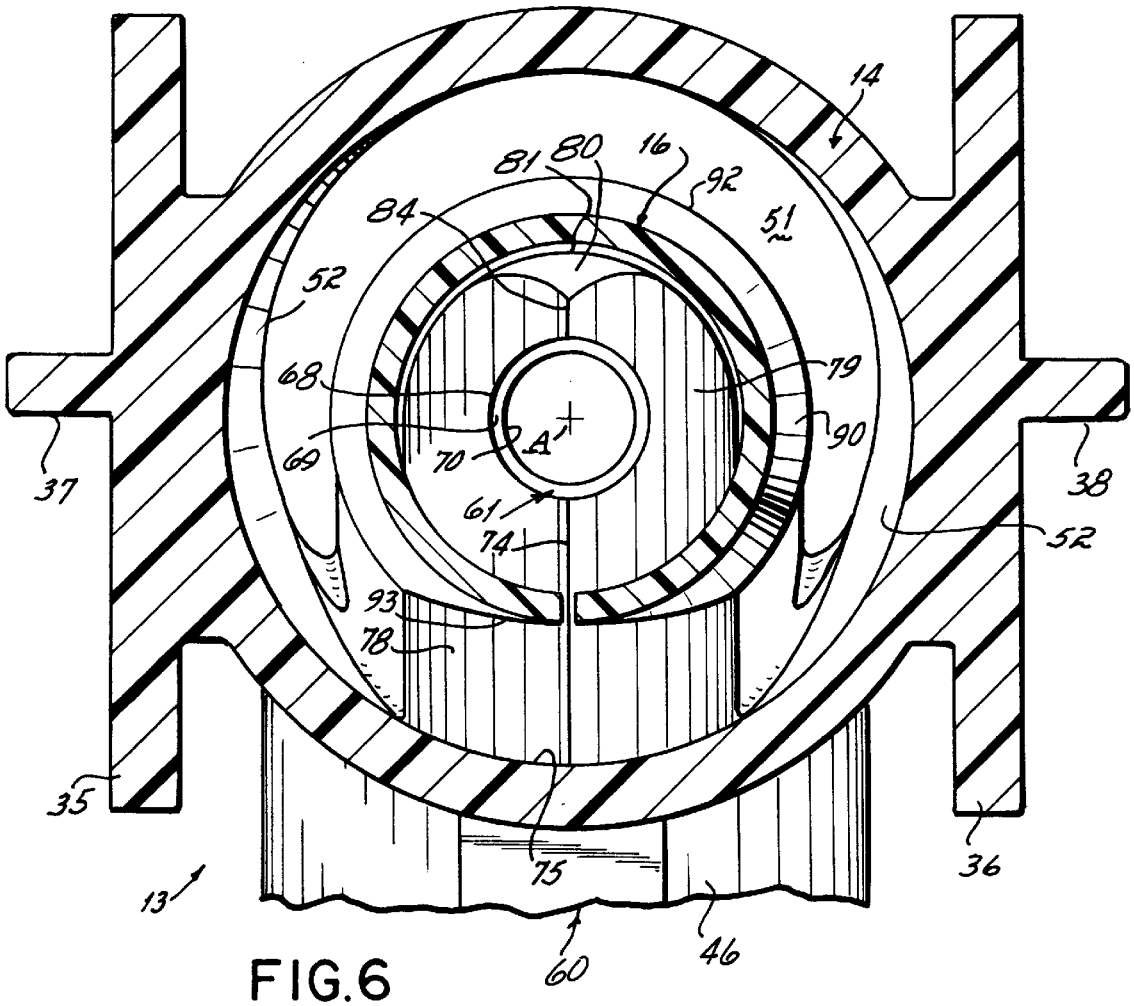
FIG. 6 is a cross-sectional view taken along lines 6—6 of FIG. 1.
Figure 7:
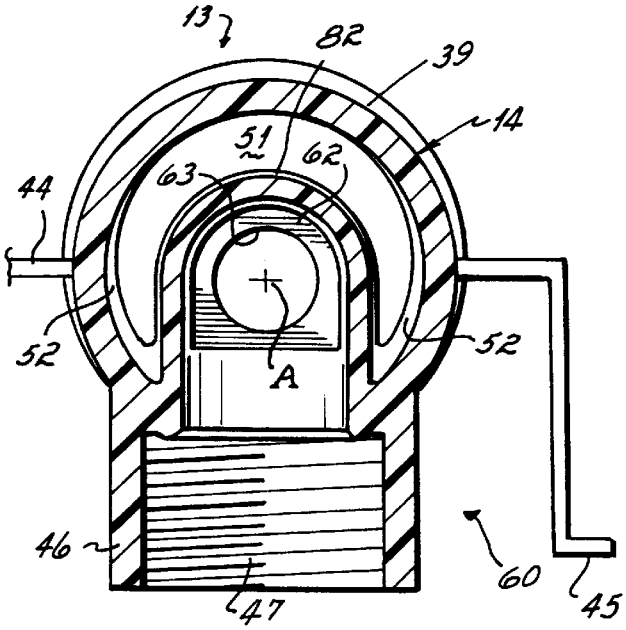
FIG. 7 is a cross-sectional view taken along lines 7—7 of FIG. 1.

In this regard, it will be appreciated that the upstream opening of the bore 68 is fully defined in the two flat surfaces 78, 79 and that the knife edge 74 extends across that opening, as illustrated, for example, in FIGS. 3 and 6. The actual venturi opening is thus somewhat U-shaped on both sides as shown in FIGS. 3 and 6. The conically-shaped surface 80 begins at an apex 84 on edge 74, and then widens out as that surface joins outer cylindrical wall 82 at juncture 81 and extends from the edges of the two flat surfaces 78, 79.

Figure 4:
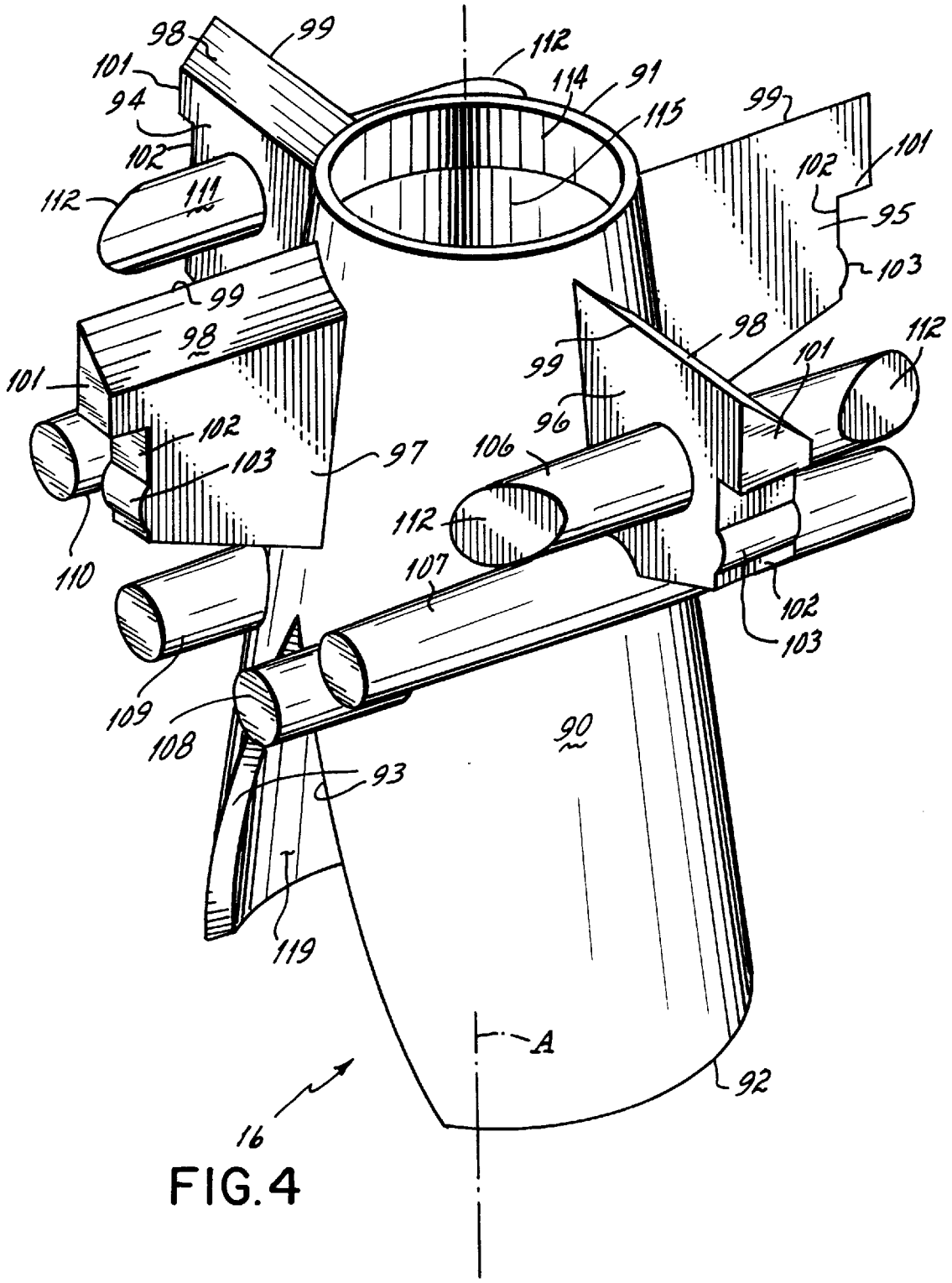
FIG. 4 is a perspective view of the shield shown in the respective figures.

Turning now to FIG. 4, shield 16 will be described in detail. Shield 16 comprises an integrally-molded conically-shaped member 90 extending from a relatively narrow upstream end 91 to a relatively wider outwardly-tapered or inclined downstream end 92. A V-shaped recess 93 is cut into the conically-shaped member 90 as shown in FIG. 4 so that, when the shield is inserted into the body through the opening 53, it can be pressed down over the venturi section with the V-shaped cutout 93 accommodating the two opposed outwardly inclined surfaces 78, 79.

The shield further comprises a series of four arms 94–97, extending from the outer conical surface 90 of the shield in perpendicular directions, as shown. The arms 94, 96 are on either side of a center axis as most clearly seen in FIG. 5. Each arm has an upper tapered surface, such as at 98 (numbered the same on each arm) which is tapered in a downstream direction from an uppermost edge 99 (numbered the same on each arm). Any water or mist striking the surface 98 of any arm is thus directed downwardly into the discharge passageway 51.

Except as described below, each of the arms are relatively identical. Each includes an upper extension 101 extending outwardly of an arm end 102 for engagement on end wall 18 of chamber 19. Each arm 94–97 is also provided with a projection 103 for frictionally engaging the inward surface of the aperture 53 in the downstream end wall 18 of the air gap chamber 19 for positioning the shield 16 in place and for frictionally holding it there.

In this connection, the aperture 53 may be provided with a groove for accepting the projections 103, but it will be appreciated that the projections are only slightly raised from the ends 102 and may not require a groove for retention.

Externally, the shield is also provided with a number of rods 106–111, as shown in various parts of the drawings. As perhaps best seen in FIGS. 4 and 5, rods 106 and 107 extend through the arm 96. It will be appreciated that the rods may not actually extend through the arms but are, rather, simply molded integrally with the arms and extend on both sides of the arm, as indicated in the figures. The same is true of rods 110 and 111 with respect to the arm 94. The uppermost rods 106, 111 have their ends cut off, as shown at 112, to facilitate the assembled relationship with opening 53.

On the other hand, rods 108 and 109 extend from the outer surface 90 of the shield and have opposite counterparts 108A and 109A extending in coaxial orientation from the opposite side of the shield. These rods do not extend through the shield which is open and unobstructed.

Figure 5:
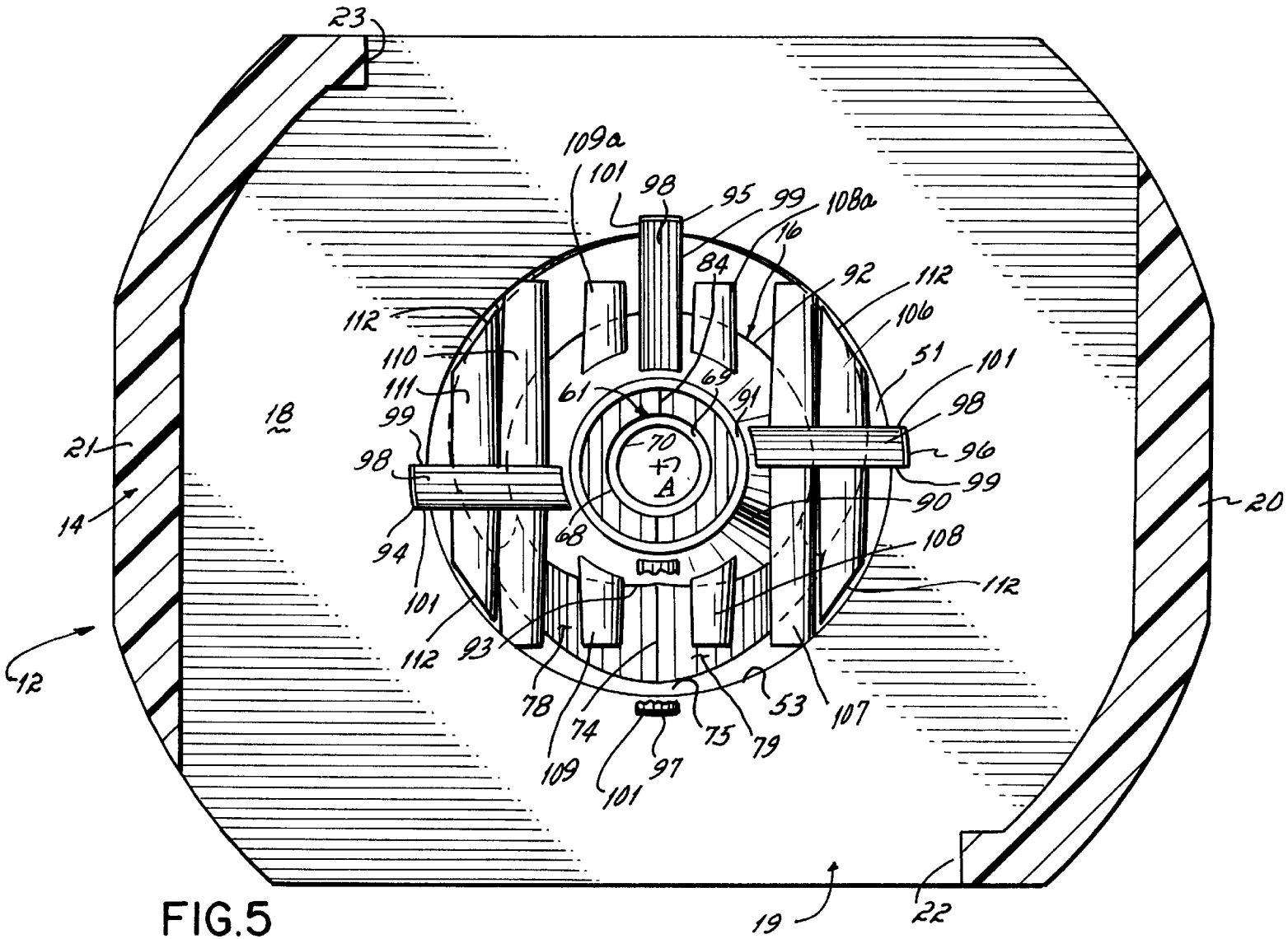
FIG. 5 is a cross-sectional view taken generally along lines 5—5 of FIG. 1.

Turning now to FIG. 5, it will be appreciated in that view that the arm 97 is partially broken away to expose the knife edge 74 in the surfaces 78 and 79 at the entry end to the venturi section 60.

Figure 2A:
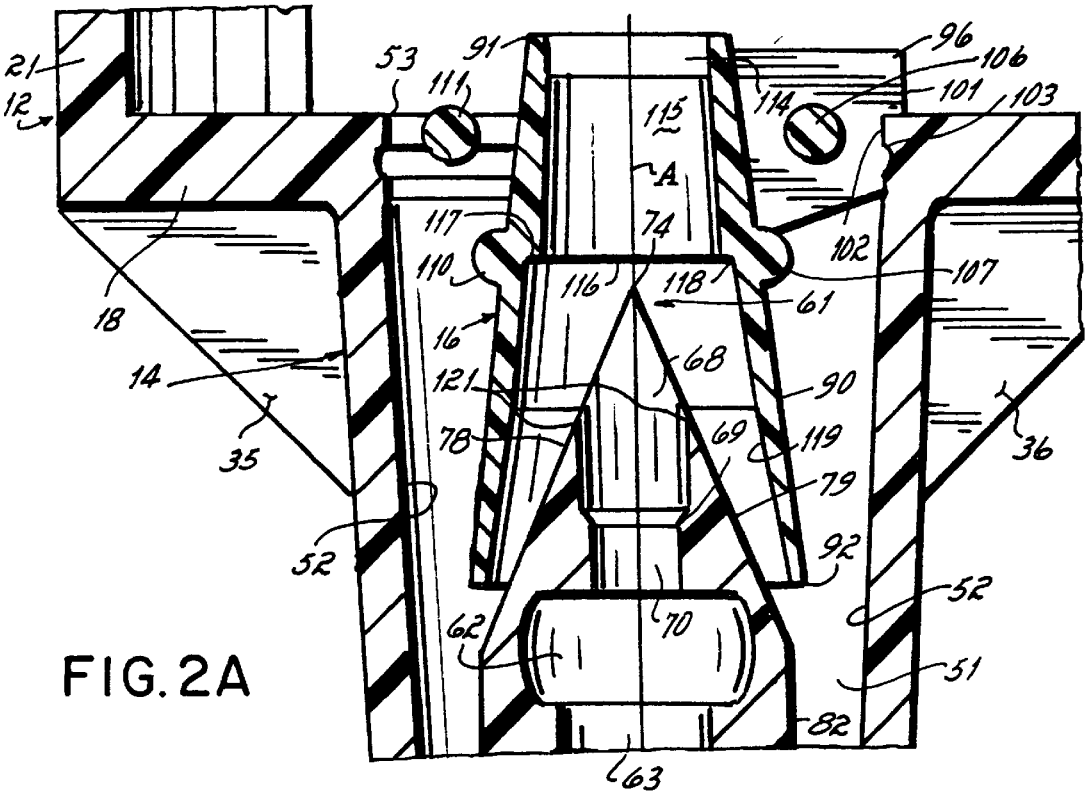
FIG. 2A is an enlarged view of the encircled section of FIG. 2.
Figure 3A:
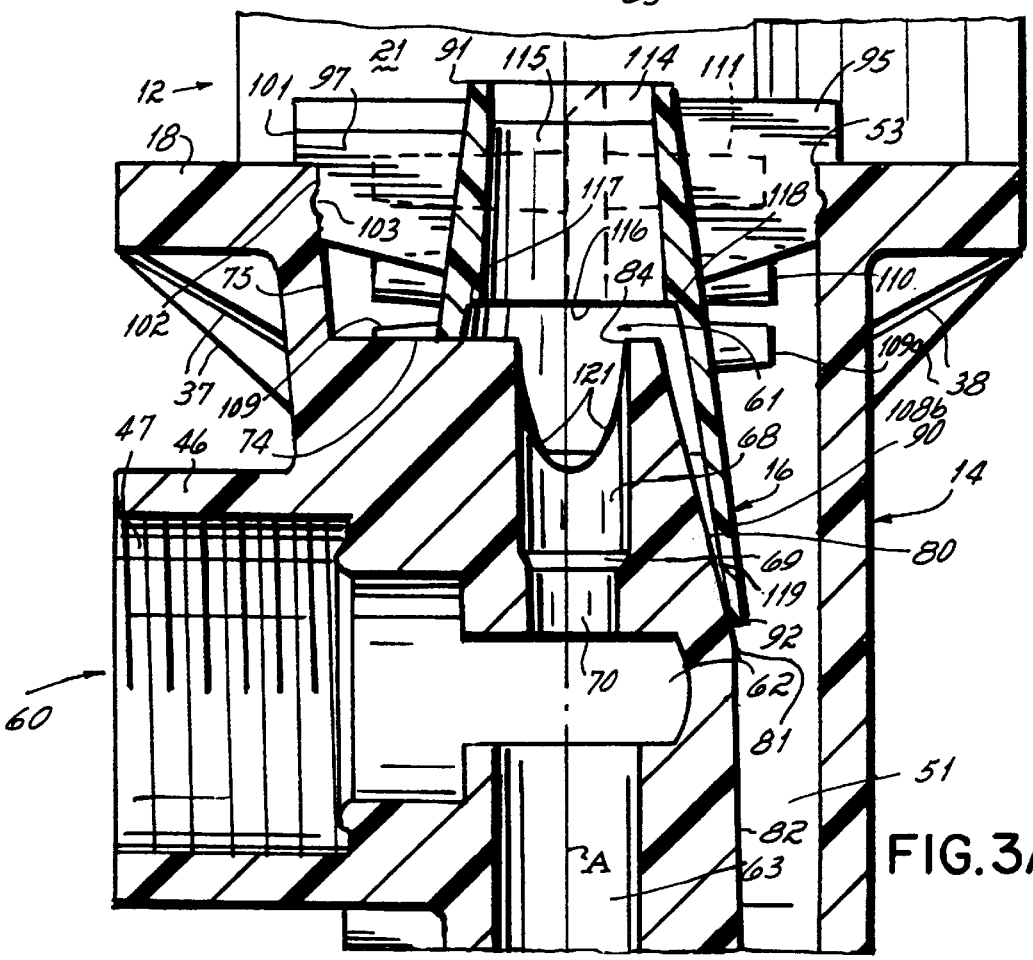
FIG. 3A is an enlarged view of the encircled area of FIG. 3.

The interior configuration of the shield 16 is perhaps best shown in profile or cross-section in FIGS. 2A and 3A. It will be appreciated that the shield is internally open and is defined by a first bore or section 114 of generally cylindrical configuration and a second section 115 of slightly inclined conical configuration and of slightly greater increasing diameter than the bore 114. The bore 114 and tapered section 115 are both preferably of a larger diameter than that of the nozzle opening 29 across the air gap chamber 19.

The section 115 terminates in a discharge end 116 at a shoulder 117, which is perpendicular to the axis A and which extends outwardly to a circular juncture 118. An interior wall 119 of the shield 16 inclines outwardly from shoulder juncture 118. It will be appreciated that the interior outwardly tapered wall tapers outwardly away from axis A and in a downstream direction from the shoulder 117 and the circular juncture it defines at 118.

It will also be appreciated that the relationship of the interior surface 119 of the shield 16 to the respective surfaces of the venturi inlet vary in cross-sectional configuration. For example, and with respect to FIG. 2A, it will be appreciated that the surface 119 is of generally frustoconical configuration disposed around the flat opposed surfaces 78, 79. At the same time, it will also be appreciated from FIG. 3A that the surface 119 of frustoconical configuration generally follows along the contour but is spaced from the conical surface 80 of the venturi inlet. In any event, it will be appreciated that the interior surface 119 of the shield 16 is disposed more closely to the exterior surfaces of the venturi inlet than to the interior wall defining the discharge passageway 51.

Again, and as noted above, it will be also appreciated that the V-shaped cut out 93 fits over and accommodates the flat surfaces 78 and 79 when the shield is installed or assembled in place, so that shield fully encloses the open mouth of the venturi defined by the knife edge 74, flats 78, 79 and the open end of the bore 68.

Turning now to a description of the operation of the eductor 10, it will be appreciated that the inlet end 11 is interconnected to a standard hose or faucet end for introducing water to the eductor 10. Typically, this will constitute a male fitting from a conduit to a water source and may be located in a proportioning cabinet or other enclosure where there is maintained one or more chemical sources for use with the eductor.

The eductor 10 is also connected through the fitting 46 to a chemical source, either directly or through a selector valve for selecting one of a plurality of chemicals.

Thereafter, all that is necessary to operate the invention is to begin the flow of water through the inlet 11. Water flowing into the inlet 11 is directed into the nozzle 15 and out of the nozzle opening 29 in a highly columnated water stream, which passes across the air gap 19 and into the upstream end 91 of the shield 16. The shield 16 thus acts partially like a nozzle which receives the stream of water across the air gap 19 and also any air drawn laminarly or in a frictional fashion with the water and into the shield. Thereafter, the water stream flows onto the venturi section 60.

Since the water stream is of generally larger diameter than the open end of the bore 68 in the venturi section 60, not all of the water in the stream can enter the venturi section. Instead, some portion of the water is cut off by the knife edge 74 and by the edges 121 of the bore 68 in the flat surfaces 78, 79 respectively.

The cut off or separated water forms bypass water moving along the outside of the venturi section 60, that is, along the surfaces 78, 79 and 80, and eventually into the discharge passage 51.

At the same time, it will be appreciated that there is some turbulence generated in the water stream at the point of entry into the venturi. Any splashing, misting or other turbulent water is captured by the shield 16 and particularly on the interior surfaces 119 thereof, which generally are disposed about the entry end of the venturi section 60.

Water, in whatever form, flowing to the interior shield surface 119, tends to form a sheet on that surface and to move in a downstream direction. Any water on that surface which tends to migrate in an upstream direction is substantially deflected by the shoulder 117. In this manner, all of the splashing, of whatever form, taking place as the water stream engages the venturi inlet, is effectively captured by the shield. The bypass water by and large continues in a downstream direction at a relatively high velocity and momentum, thereby carrying any droplets or overspray therewith. That which is not so carried engages the shield surface 119, sheets out, and is also directed then in a downstream direction.

Water entering the venturi bore 68 passes therethrough, passes through the taper 69 and into the bore 70 to the eductor inlet 62. The high velocity of water passing the eductor inlet creates a low pressure and tends to draw chemical up through that inlet and into the water stream. Thereafter, the mixed water stream and chemical flow through the discharge passage 63 into the outlet 64 which, as shown in FIG. 3, for example, extends below the outlet 50 for the other discharge passageway 51. At the same time, bypass water which does not enter the venturi moves through the discharge passage 51 to the outlet 50.

It will be appreciated that separate hoses can be connected to the respective discharge outlets 50, 64. A smaller hose, for example, is connected to the venturi discharge outlet 64, while a larger hose is passed over the smaller hose and is connected to the discharge outlet 50.

The distal ends of these hoses can be disposed and located in a receptacle such as a bucket. For example, where the chemical is concentrated soap, then the chemical drawn into the water stream is discharged into the bucket, as well as the bypass water flowing through the discharge passage 51.

As indicated above, it will be appreciated that the water stream in the air gap 19 tends to entrain air in the water stream. This air goes both into the shield 16 and is then cut off at the venturi inlet, thus passing between the shield 16 and the venturi section 60 and carrying water droplets and any bypass water with it.

At the same time, any additional air flowing toward the shield 16 enters the open discharge passageways 51 past the arms 94–97. Any moisture droplets or mist flowing in this direction and engaging the tapered surfaces 98 of these arms is thus directed downwardly into the discharge passage as well.

In addition, if there is any turbulence in the discharge passage 51, such as at the downstream end 92 of the shield 16 tending to form any droplets which move in an upstream direction, those droplets tend to engage and collect on the rods 106–111 and thereafter are entrained in downwardly moving air in a discharge direction in a discharge passage 51.

It will be appreciated that when the discharge tubes are disposed in a bucket, any water in the discharge passage must be driven out of the tube against the pressure in the bucket. This pressure is provided, for example, by the high velocity and momentum of the bypass water discharging between the venturi section 60 and the interior surface 119 of the shield 16.

The vent provided by the open end of the discharge passage 51 into the air gap chamber 19 provides for a venting of any air in the tube, so that it can move outwardly through the air gap chamber 19 and is not forced into the bucket, such as would cause undesirable foaming.

It will also be noted that in prior eductors, there tended to be an optimum operating parameter between too little spitting and too much spitting. If there was too little spitting at the venturi inlet, the bypass water flow would tend to take the form of and be generated into droplets. Air, outside the venturi section and moving in an upstream direction, could carry these back upwardly into the air gap and out the windows, producing too much undesirable mist. On the other hand, if there was too much spitting at the venturi inlet, there would be too much water in the discharge passageway, which could actually flood the unit and back up the eductor.

In the present invention, however, the water hitting the interior surface 119 of the shield forms a sheet of water, much like a water fall, and this water is not easily formed into droplets. The water sheet itself acts as its own shield then and entrains any water droplets which do happen to form, and carries those droplets in a downstream direction by the force of the bypass water passing around the eductor section.

Accordingly, it will be appreciated that the invention provides an improved air gap eductor of only three parts; that is an integral body, a nozzle and a shield. The relative width of the air gap chamber walls and the body stiffening ribs tend to provide a relatively stiff construction, maintaining the nozzle, the shield and the venturi in a coaxial format, despite normal use manipulation of the eductor. This maintains the desired stream alignment into the venturi.

At the same time, the improved shield substantially reduces backsplashing and misting and enhances the overdriving of the venturi by capturing any bypass water in a uniform and desirable format and directing it at substantial velocity and momentum downwardly through a discharge tube, all for efficient eduction and appropriate proportioning of the chemical and discharge thereof, while maintaining the anti-syphoning and anti-backflow parameters of an air gap eductor.

These and other objectives and advantages will become readily apparent to those of ordinary skill in the art without departing from the scope of the invention, and the applicants thus intend to be bound only by the claims appended hereto.

What is claimed:

1. An air gap eductor comprising:

an eductor body, a nozzle disposed in said body, an integral venturi section in said body having an inlet for receiving a stream across a gap from said nozzle, and a shield disposed between said nozzle and said venturi section and around said inlet, said shield having outwardly tapered surfaces around said inlet in a downstream direction.

2. An air gap eductor as in claim 1 wherein said body has an air gap chamber, said nozzle disposed in an upstream end of said chamber and said shield in a downstream end of said chamber, said body having an elongated discharge passage downstream of said downstream chamber end, said venturi section comprising an integral portion of said body extending into said discharge passage.

3. An air gap eductor as in claim 2 wherein said venturi inlet comprises a first bore and a downstream second bore of smaller diameter than said first bore.

4. An air gap eductor as in claim 2 wherein said venturi inlet is defined by two opposed flat, outwardly tapering surfaces and a conical surface extending between said two flat surfaces.

5. An air gap eductor as in claim 4 wherein said shield surrounds said two flat surfaces and said conical surface.

6. An air gap eductor as in claim 5 wherein said discharge passage has interior walls and said shield is closer to said venturi section than to said discharge passage interior walls.

7. An air gap eductor as in claim 6 wherein said venturi inlet defines an edge at the intersection of said two flat surfaces, said two flat surfaces extending into interior walls of said discharge passage.

8. An air gap eductor as in claim 1 having an annular overspray passage within said body outside said shield and said venturi section.

9. An air gap eductor as in claim 8 wherein said surface body includes a discharge end and said annular overspray passage is open to said gap and extends to said discharge end of said body.

10. An air gap eductor as in claim 8 wherein said venturi section has an outlet extending at least to said discharge end of said body.

11. An air gap eductor as in claim 1 wherein said nozzle has a circular inlet end and a conical discharge end defining a nozzle orifice, and a plurality of screens disposed in the inlet end of said nozzle.

12. An air gap eductor as in claim 1 wherein said body defines an enlarged air gap section and an integral discharge section, and further including a plurality of stiffening ribs extending between said air gap section and said discharge section.

13. An air gap eductor as in claim 12 wherein said discharge section includes a plurality of elongated stiffening ribs extending along said discharge section.

14. An air gap eductor as in claim 13 wherein an eductor inlet boss is formed integrally in said discharge section and said elongated stiffening ribs extend between said boss and an end of said discharge section.

15. An air gap eductor as in claim 14 wherein said integral venturi section has a discharge outlet extending beyond said discharge section of said body.

16. An air gap eductor as in claim 1 wherein said body defines an air gap section having upstream and downstream ends and at least two windows therein with said air gap section being open through said windows.

17. An air gap eductor as in claim 16 wherein said windows are defined by asymmetric air gap chamber walls, one of which is the mirror image of the other.

18. An air gap eductor comprising:

a molded body defining an inlet end, defining an air gap chamber having an upstream end proximate the inlet end of the body and a downstream end, and defining a discharge section having a discharge passageway and having an integrally molded venturi section extending from an interior wall of said discharge section and having a venturi inlet end, a nozzle disposed in said body at an upstream end of said air gap chamber, and a shield disposed about said venturi inlet end, said shield having a plurality of support arms extending outwardly thereof for supporting said shield in the downstream end of said chamber, and said shield having a conical shape diverging in a downstream direction and disposed about said venturi inlet end.

19. An air gap eductor as in claim 18 wherein said venturi inlet end has two opposed outwardly inclined surfaces extending from walls of said discharge passageway and connected at their ends away from said passageway walls by a conical surface, said two flat surfaces intersecting at an upstream end of said inlet.

20. An air gap eductor as in claim 19 wherein said shield has a V-shaped opening in said conical shape, opening in a downstream direction from an apex, and disposed over said flat surfaces extending from said passageway walls.

21. An air gap eductor as in claim 19 wherein said shield has a plurality of rods extending outwardly therefrom toward said passageway walls.

22. An air gap eductor as in claim 21 wherein at least one rod extends outwardly from the conical shape of said shield and at least one rod extends outwardly from at least one of said support arms.

23. An air gap eductor as in claim 18 wherein said conically shaped shield is disposed closer to said venturi section than to said interior wall of said discharge section.

24. An air gap eductor as in claim 23 wherein said venturi inlet end has a venturi passageway defined by an inlet bore of one diameter and a downstream bore of a second diameter smaller than said first diameter.

* * * * *